US009044373B2

(12) United States Patent
Welch

(10) Patent No.: US 9,044,373 B2
(45) Date of Patent: Jun. 2, 2015

(54) METHOD AND APPARATUS FOR IMPROVING CERVICAL CURVATURE AND FOR MAINTAINING PROPER CURVATURE IN PERSONS PREDISPOSED TO DEVELOP IMPROPER CURVATURE

(71) Applicant: Elizabeth A Welch, St. Charles, IL (US)

(72) Inventor: Elizabeth A Welch, St. Charles, IL (US)

( * ) Notice: Subject to any disclaimer, the term of this patent is extended or adjusted under 35 U.S.C. 154(b) by 0 days.

(21) Appl. No.: 14/161,805

(22) Filed: Jan. 23, 2014

(65) Prior Publication Data

US 2014/0148852 A1 May 29, 2014

Related U.S. Application Data

(63) Continuation-in-part of application No. 12/799,346, filed on Apr. 22, 2010, now Pat. No. 8,672,818.

(51) Int. Cl.

| | |
|---|---|
| ***A63B 21/002*** | (2006.01) |
| ***A63B 21/06*** | (2006.01) |
| ***A63B 21/00*** | (2006.01) |
| ***A63B 23/025*** | (2006.01) |
| ***A61H 1/00*** | (2006.01) |
| ***A63B 21/055*** | (2006.01) |
| ***A63B 21/072*** | (2006.01) |
| ***A63B 23/02*** | (2006.01) |
| ***A61H 1/02*** | (2006.01) |
| ***A63B 21/04*** | (2006.01) |

(52) U.S. Cl.

CPC ..... *A61H 1/008* (2013.01); *A63B 21/0557* (2013.01); *A63B 21/0724* (2013.01); *A63B 23/0238* (2013.01); *A61H 1/0296* (2013.01); *A63B 21/0442* (2013.01); *A63B 21/0552* (2013.01)

(58) Field of Classification Search

CPC ... A61H 1/008; A61H 1/0292; A61H 1/0296; A63B 21/00141; A63B 21/0023; A63B 21/065; A63B 21/1407; A63B 23/025; A63B 2023/006

USPC ..... 482/131, 132, 139; 601/63, 120, 121

See application file for complete search history.

(56) References Cited

U.S. PATENT DOCUMENTS

| | | | | | |
|---|---|---|---|---|---|
| 3,419,268 | A * | 12/1968 | Bellet | 482/132 |
| 3,842,453 | A * | 10/1974 | Redfield | 5/643 |
| 5,577,995 | A * | 11/1996 | Walker et al. | 601/120 |
| 5,649,884 | A * | 7/1997 | Manalo | 482/91 |
| 5,824,013 | A * | 10/1998 | Allen | 606/240 |
| 5,891,003 | A * | 4/1999 | Deac et al. | 482/106 |
| 2006/0211551 | A1 * | 9/2006 | Mandell | 482/121 |

* cited by examiner

*Primary Examiner* — Oren Ginsberg
(74) *Attorney, Agent, or Firm* — Carla Gannon Law

(57) ABSTRACT

A core muscle exercising and resistance training device includes a weighted bar having opposed bar ends adapted to removably mount at least one weight or other force generating element. A pad element is removably and frictionally mounted on the bar, the pad element being constructed from a lightweight foam material having a density within a specific range. The pad has an outer surface with a radius of curvature substantially the same as a normal cervical curvature. In use, the outer pad surface is placed adjacent a user's cervical curve and the weighted bar, the additional isometric resistance generating elements and the pad element act in combination to apply a force upon the user's core cervical curve muscles for improving the user's cervical curve posture by gradually modifying the cervical curvature to conform with clinically desirable curvature.

5 Claims, 9 Drawing Sheets

METHOD AND APPARATUS FOR IMPROVING CERVICAL CURVATURE AND FOR MAINTAINING PROPER CURVATURE IN PERSONS PREDISPOSED TO DEVELOP IMPROPER CURVATURE

CROSS-REFERENCE TO RELATED APPLICATIONS

This application is a continuation-in-part of U.S. patent application Ser. No. 12/799,346, filed Apr. 22, 2010, titled "Method and Apparatus for Improving Posture."

BACKGROUND OF THE INVENTION

1. Field of the Invention

The present invention generally relates to methods and devices for treating and exercising various core muscle groups in the human body. More particularly, the present invention relates to methods and devices for treating and exercising core muscle groups in the neck, shoulders, upper back, and abdominal region related to the cervical curvature for supporting, improving, and maintaining proper head and neck posture, as well as overall posture. The device works by a variety of mechanisms, including manipulation, strengthening and establishing muscle memory.

2. Description of the Prior Art

Exercise devices that target specific muscle groups are known, including those core muscle groups that are associated with maintaining lumbar support. In addition, bar-like exercise devices that rest on or about the shoulders for training core muscle groups are also known. An example is a padded bar intended to comfortably facilitate lateral twisting motion in order to strengthen the external oblique muscles of the abdomen.

However, known devices that target specific muscle groups, and particularly bar-like devices, are not well-suited for treating and exercising core muscle groups in the neck, shoulders, upper back, and abdominal region related to the cervical curvature for supporting, improving, and maintaining proper head and neck posture, as well as overall posture. Rather, known devices are structurally improper with respect to bar length, padding curvature, padding width, padding density and/or bar weight, thereby rendering the device of little to no use in achieving the goals associated with using the present invention. In addition, known devices aren't configured to releaseably receive exercise bands, thereby further limiting their functionality.

It is a primary object of the present invention to treat, improve and/or maintain a user's overall posture, specifically the cervical curve posture.

It is another object of the present invention to improve a user's cervical curvature from an abnormal curvature to a normal curvature of between 34-42 degrees, measured as an angle between the C2-C7 vertebrae from a side view of the human spine.

It is another object of the present invention to strengthen core muscles associated with improving and/or maintaining posture.

SUMMARY OF THE INVENTION

The present invention essentially provides a treatment or exercise device for exercising core muscle groups through resistance and flexibility training, which core muscles groups are around the neck, shoulders and upper back, and abdominal region, and relate to and affect, cervical curvature. Use of the present invention results in improving overall posture, particularly cervical curve posture. The core muscle exercising device of the present invention, in an embodiment, comprises a bar element with a bar sheathing, friction-fit end caps, a pad element, and a pad sheathing or cover. Optionally, the bar element may have externally threaded ends, removable and attachable opposed, ridged end caps, removable and attachable opposed threaded end weights, and removable and attachable resistance bands. The bar element may be cylindrical in geometry and constructed from a weighty material such as wood, steel, rigid PVC, or other suitable material and has opposed bar ends. The bar diameter which is a direct function of the bar's weight, is chosen or selected from a number of diameters depending on the user's physique and capability.

The pad element is cylindrical in geometry and constructed from a relatively lightweight, or negligible in weight, foam material with a specific density appropriate for isometric exercise. The pad element has opposed pad ends and a pad length of about one-third the length of the bar length. The pad element further comprises a cervical curve-accommodating or receiving outer pad diameter in the range of 2.8 to 4.8 inches, or a radius of curvature in the range of 1.4 to 2.4 inches, and in an embodiment, about 3.8 inches in diameter, thereby effecting a radius of curvature on the order of 1.9 inches. The pad element further comprises a bar-receiving, inner pad diameter for receiving the bar element.

The bar element is received in a tunnel extending axially through the pad element such that the two cylindrical elements are coaxial. Further, the bar element is received in the pad element tunnel such that the pad element is centered along the bar length equidistant from the bar ends. The outer pad diameter is specifically sized in a range to accommodate, or be received in, a user's cervical curve for providing tactile information to the user as to how or to what degree the user's cervical curve should be adjusted, so that the user's cervical curvature will ultimately approximate the radius of curvature of the outer pad diameter and obtain a normal cervical curvature between 34-42 degrees, measured as an angle between the C2-C7 vertebrae from a side view of the human spine.

A variety of bar weights may be employed, depending on the user's physique, fitness level and capabilities. It is thus contemplated that a first bar element may comprise a weight on the order of approximately 240 ounces; a second bar element may comprise a weight on the order of approximately 192 ounces; a third bar element may comprise a weight on the order of approximately 144 ounces; a fourth bar element may comprise a weight on the order of approximately 96 ounces; a fifth bar element may comprise a weight on the order of approximately 64 ounces; and a sixth bar element may comprise a weight on the order of approximately 32 ounces. The significantly lighter weight of the sixth bar element may be achieved by using a material such as wood or tubular steel. These weight amounts may be varied incrementally with the addition of varying weights to the ends of the bar, and/or attaching resistance bands to the ends of the bar.

Together the muscular activity associated with resistance training that operates against the back of the neck and the fixed outer pad diameter or outer pad radius of curvature (that substantially matches and/or conforms to that of a normal cervical curvature) operates to treat and strengthen the core muscles. This isometric resistance improves and/or maintains posture, particularly normal cervical curve posture.

BRIEF DESCRIPTION OF THE DRAWINGS

The present invention is further described with reference to the accompanying drawings in which:

FIG. 3(*b*) is a schematic side view of a user's cervical curve with an embodiment of the present invention being shown lodged against the rear neck portion adjacent the user's cervical curve;

FIG. 7(*a*) is a plan view of the device of FIG. 7, with additional weights shown removably attached to opposite ends of the bar element;

DETAILED DESCRIPTION OF THE ILLUSTRATED EMBODIMENTS

As used herein, the following structure numbers apply throughout the various FIGS:

10—Exercising device;
11—Bar element;
11*a*—Externally threaded ends;
12—Bar sheathing;
13—Ridged caps;
13*a*—Internally threaded weights;
14—Pad element;
15—Pad sheathing;
16—Bar receiving slot;
17—Inner pad tunnel;
18—Hook fastener;
19—Loop fastener;
20—Ties;
31'Steel ring;
32—Set screw;
33—Swivel hook;
51—Strap;
52—Connection strip;
53—Connection ring;
71—Resistance band;
100—Bar length;
101—Pad length;
102—Proper cervical curvature;
103—Improper cervical curvature;
104—Outer pad diameter;
110—Isometric force;
111—Vector;
115—Improper forward lean; and
116—Negligible lean.

Figures 1, 2:
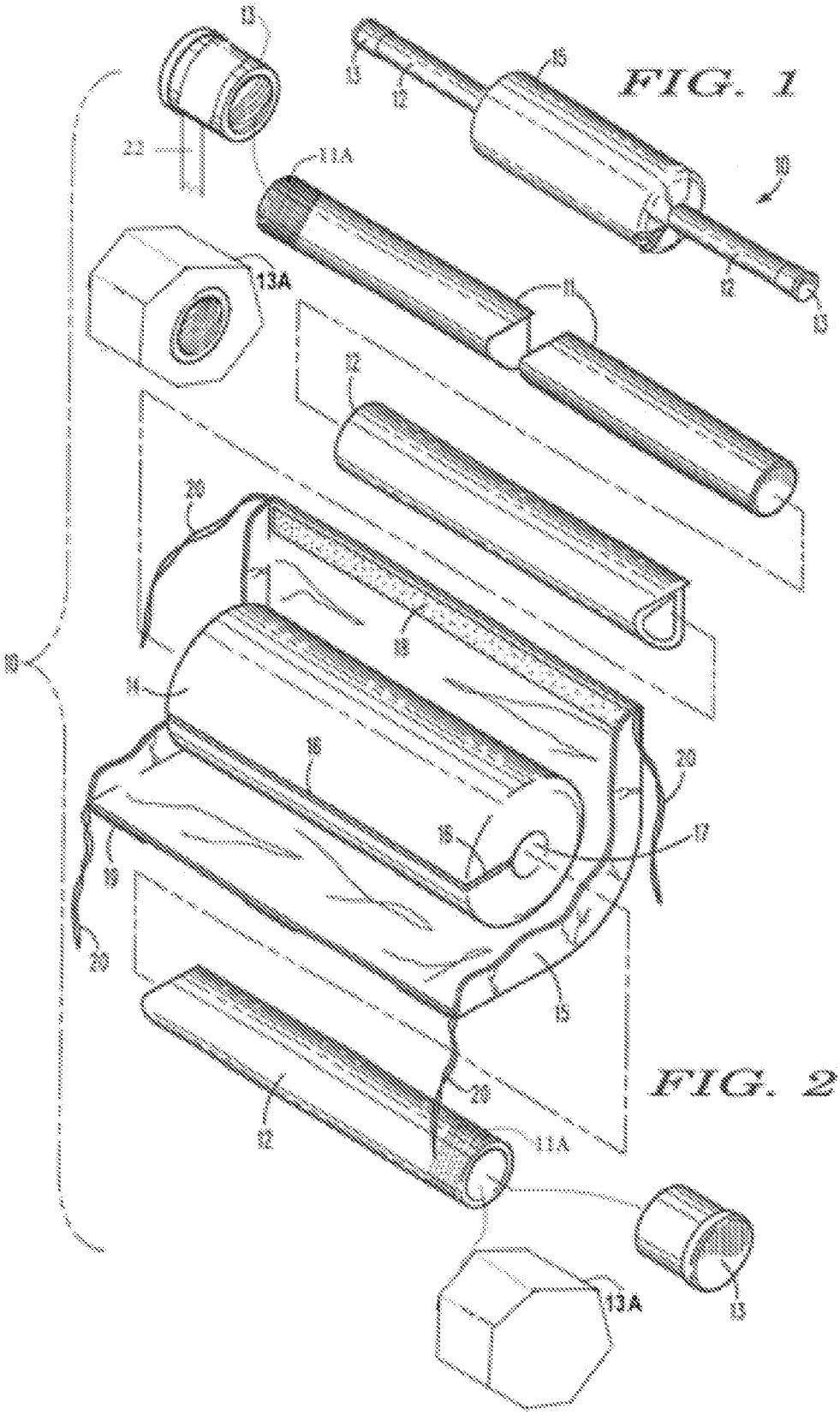
FIG. 1 is a top perspective view of an embodiment of an assembled core exercising device of the present invention.
FIG. 2 is a fragmentary exploded perspective view of an embodiment of the core exercising device of the present invention, with certain parts broken away for illustrative purposes.

Referring to the drawings, an illustrated embodiment of the present invention essentially provides a mobile core muscle treatment and exercising device 10, as shown in FIG. 1, for exercising and maintaining core muscle groups associated with the cervical vertebrae of a user with an eye toward improving overall posture, particularly the cervical curve posture of the user. In addition, the dynamics of the entire kinetic chain are affected where benefits are made throughout the musculoskeletal system including cervical, thoracic and lumbar spine as well as the axial skeletal system. Pursuant to clinical definitions within the chiropractic practice, and more specifically, the chapter on cervical lordosis found in the CBP Structural Rehabilitation of the Cervical Spine by Dr. Deed Harrison, Dr. Don Harrison and Dr. Jason Haas, the normal cervical curve posture is between approximately 34-42 degrees, measured as an angle between the C2-C7 vertebrae from a side view of the human spine adjacent the neck, as depicted at 102 in FIG. 10. An abnormal cervical curvature would be any cervical curve falling outside of this range, one such variance known as forward head posture.

As used herein, "core muscles" and the like include neck, back, abdomen and shoulder muscles. It should be understood, however, that while embodiments of the present invention target these muscles, other muscles, including those involved in stabilization, balance, and so forth, would also be used.

Figure 3A:
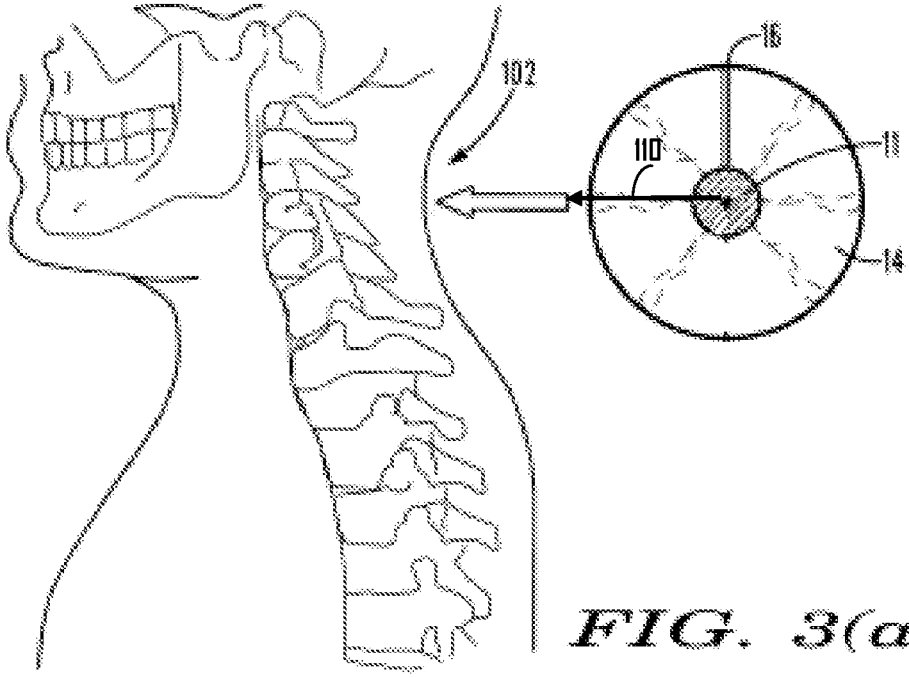
FIG. 3(*a*) is a schematic side view of a user's cervical curve with an embodiment of a weighted core exercising in position to be received in the user's cervical curve.
Figure 3B:
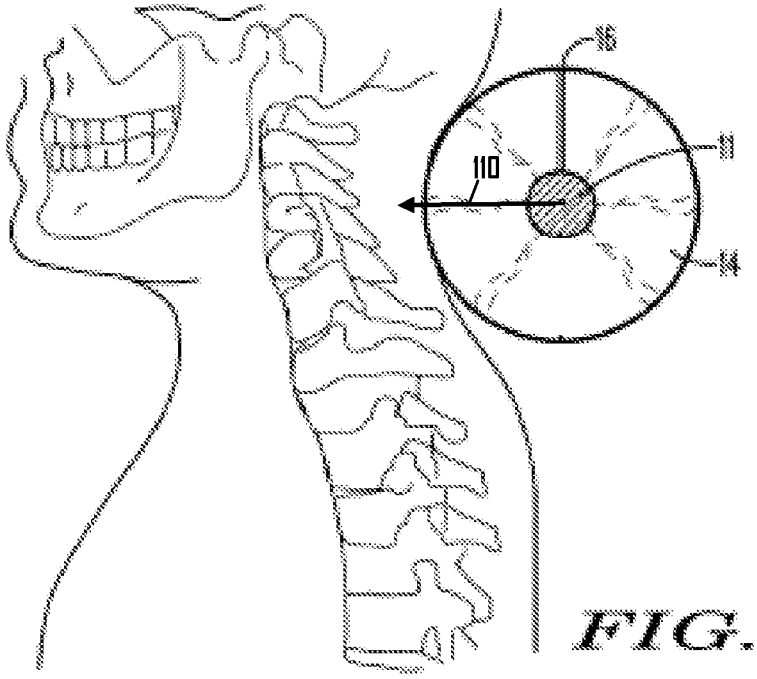
Figure 4:
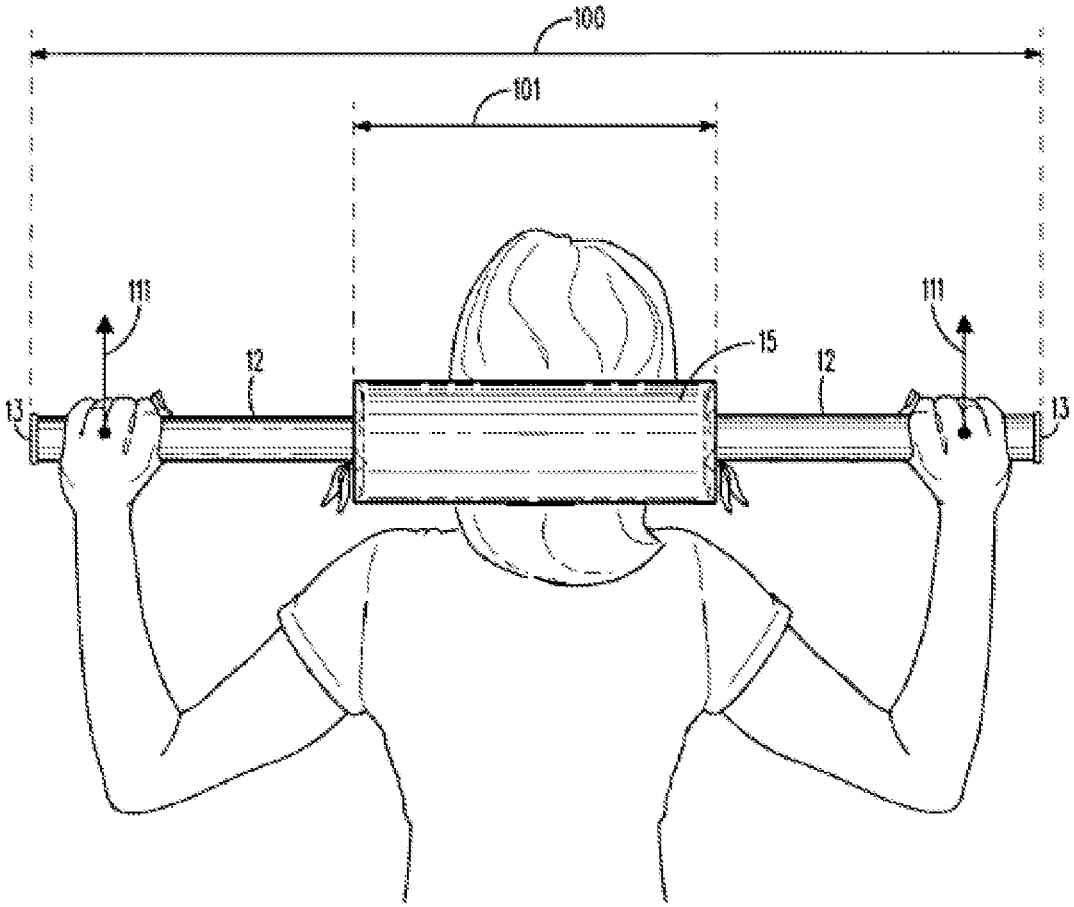
FIG. 4 is a rear view of the upper portions of a user holding an embodiment of a weighted core exercising device of the present invention shown lodged against the rear neck portion adjacent the user's cervical curve.
Figure 8:
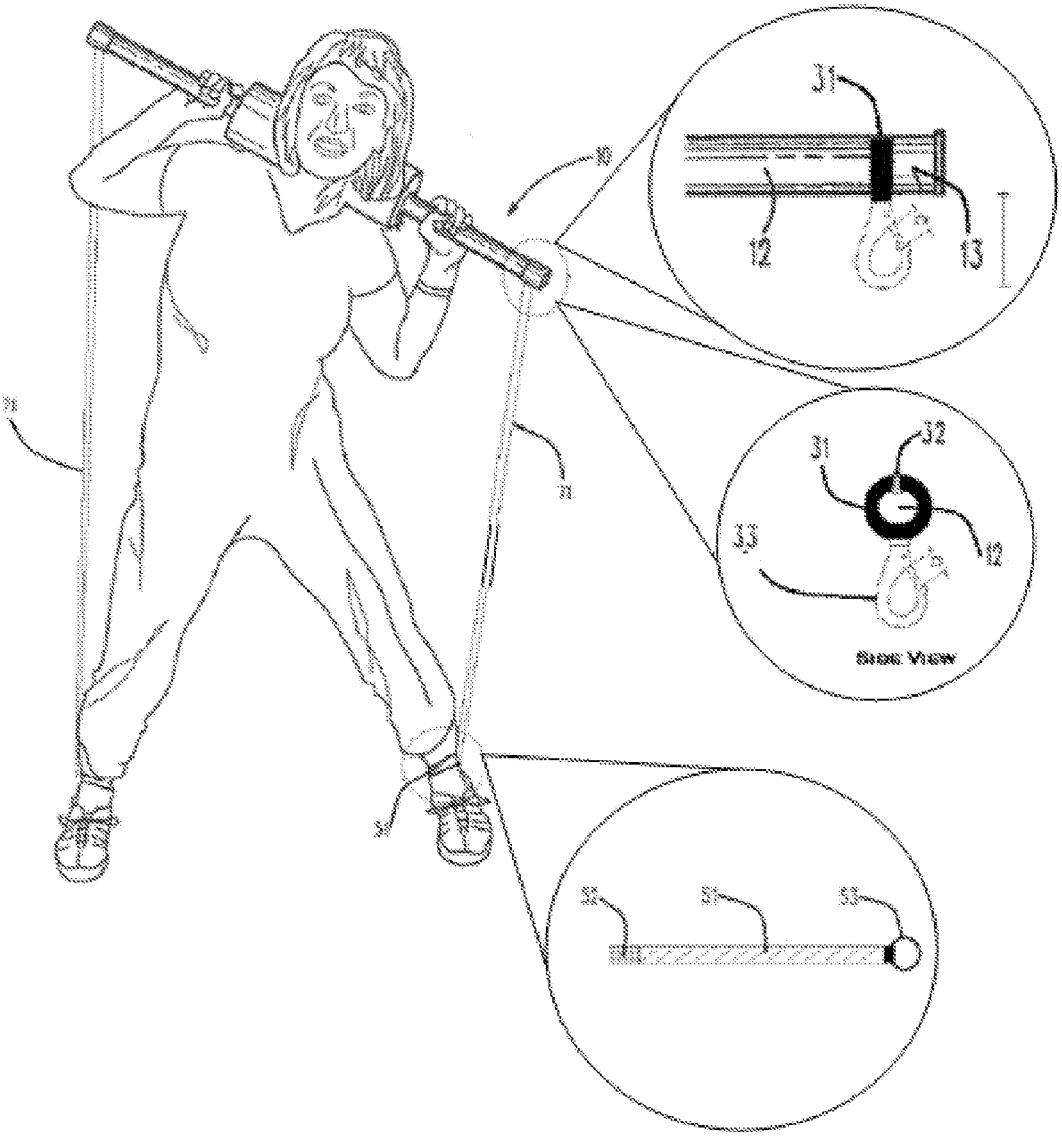
FIG. 8 is a front view of a user holding an embodiment of a weighted core exercising device of the present invention adjacent the rear neck portion in a core muscle exercising position with use of resistance bands, with resistance band attachment depicted in an exploded view.
Figure 10:
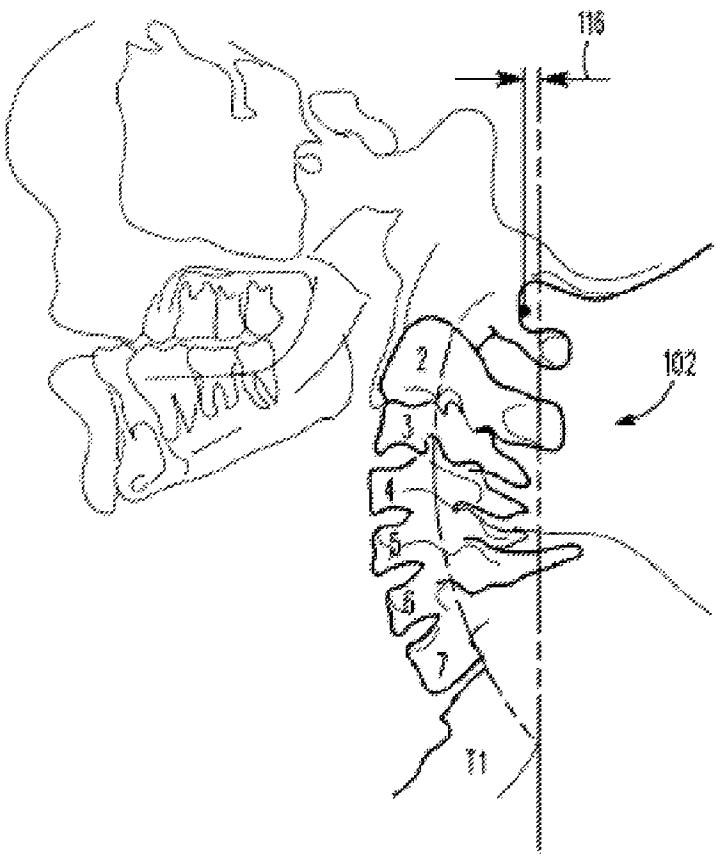
FIG. 10 is a fragmentary side view of a cervical curve anatomy showing a normal cervical curve alignment.

It will be noted from FIG. 10 that a normal or proper cervical curvature 102 comprises a normal or typical radius of curvature with minimal or negligible lean 116. Greater than >0.5 inches is considered outside normal. This is important because pad element 14 of the present invention provides optimum results when the radius of curvature of pad 14 is in the range of 1.4 to 2.4 inches. In the illustrated embodiment, a radius of curvature for pad 14 of 1.8 inches was selected. It has been determined that a pad radius of curvature approximating these dimensions provides the preferred arch of the neck when the neck is in proper posture. The pad element 14 cradles and supports the neck and encourages the proper contour of the cervical spine, when used as depicted in FIGS. 3*b*, 4 and 8. The radius of curvature of pad 14 in this range would not be satisfactory for use in the treatment of the lower back, or lumbar vertebrae, of a user, since the norms of curvature, or lordasis, of the lumbar vertebrae and the cervical vertebrae are not the same. As a result, a device similar to the present invention having a pad with a radius of curvature out of the range mentioned above would not effectively improve an abnormal cervical curvature. Likewise, a device similar to the present invention constructed of a pad element outside the recommended density would not effectively improve an abnormal cervical curvature.

Figure 9:
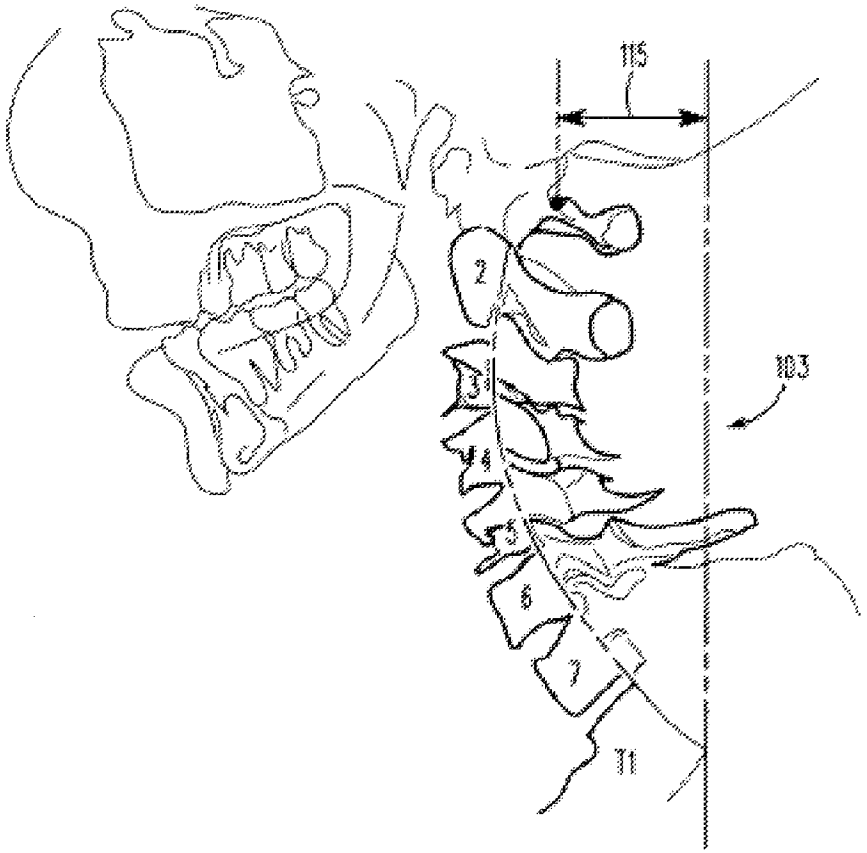
FIG. 9 is a fragmentary side view of a cervical curve anatomy showing an abnormal, forward lean of the cervical curve.

FIG. 9, by comparison, depicts an abnormal cervical curvature and improper forward lean 115 at the cervical curve, which the present invention is designed to improve or remedy by physical treatment. The present invention is thus constructed with a view toward improving the cervical posture depicted in FIG. 9 and for maintaining the proper cervical posture 102 depicted in FIGS. 3(*a*), 3(*b*), and 10. As used herein, "improving" means changing cervical posture from abnormal to either less clinically abnormal, or to clinically normal. "Maintaining" means not measurably changing cervical posture, yet should still be considered an "improvement" insofar as posture naturally deteriorates over time, so unchanged posture is an improvement over what the posture would be without using the present invention. More specifically, certain people who are predisposed to losing their normal spine curvature would benefit from the apparatus and methods of the present invention by preventing their normal spine curvature from deteriorating. Predisposed people include elderly, those with degenerative muscle or bone conditions, those who previously had abnormal spine curvature but improved it to normalcy, overweight people and people with bad posture, Referring to FIG. 2, an illustrated embodiment of the core muscle exercising device 10 of the present invention comprises a bar element 11 and a pad element 14. The bar element 11 is surrounded by a bar sheathing 12 to provide grip and safety. Bar element 11 defines externally threaded ends 11A at both ends engageable with opposed internally threaded ridged caps 13, or with opposed, internally threaded weights 13A.

Referring to FIG. 8, resistance bands 71 can be attached to the exercise device 10 via a steel ring 31 with swivel hook 33 connection and attached to the user's body, via ankle or foot straps 51. In this configuration, steel ring 31 with a swivel hook 33, is placed over the bar element 11, before adding the end cap 13. The steel ring 31 is secured in place by a set screw 32. Strap 51 is comprised of a multi-weave Nylon strap with a connection ring 53 on one end and a connection strip 52, preferably hook and loop type, on the other end, which is used to secure the ankle strap 51 to the user's ankle. Optionally, the user can stand on the nylon center section of the band.

While it is possible to use commercially available resistance bands, such as Xertube, from SPRI Products, Inc. of Libertyville, Ill., it is preferred to use resistance bands of the present invention, which include shorter resistance bands that support integrated swivel clips to connect other components, as shown in FIG. 8. The resistance bands 71 are comprised of two sections of high quality synthetic rubber with swivel clips on each end and, optionally, one section of heavy-duty, multi-weave nylon strap with D-rings on each end. The nylon strap can be attached to the two sections of synthetic rubber, creating one long band. The sectional design allows the user to stand on the nylon strap, located in the middle of the band, rather than having to step on a single rubber band, which can cause damage and decrease the life expectancy of the band. Optionally, each individual synthetic rubber band section can be attached to the user's ankles via ankle straps, or to the foot via a foot strap.

Bar element 11 in an embodiment is cylindrical in geometry, and is constructed from a weighty bar material, such as wood, steel, rigid PVC or other suitable material. The bar element 11 in the illustrated embodiment has a bar length 100 of approximately 36 inches intermediate bar ends 11A, and a bar diameter as chosen or selected from a number of diameters depending on the user's physique, fitness level and capability. The weighty material of the bar element 11 provides an isometric force 110 (FIG. 3*b*) on the body, which is used for strength training. In addition, the bar element 11 is used for isometric resistance by the user exerting force, preferably forwardly-directed force, to the rear neck portion, while engaging the core muscle of the abdomen. Downward force on the body can also be applied by weights 13A on both ends of bar 11 (FIG. 2), or by resistance bands 71 (FIG. 8).

Figure 11:
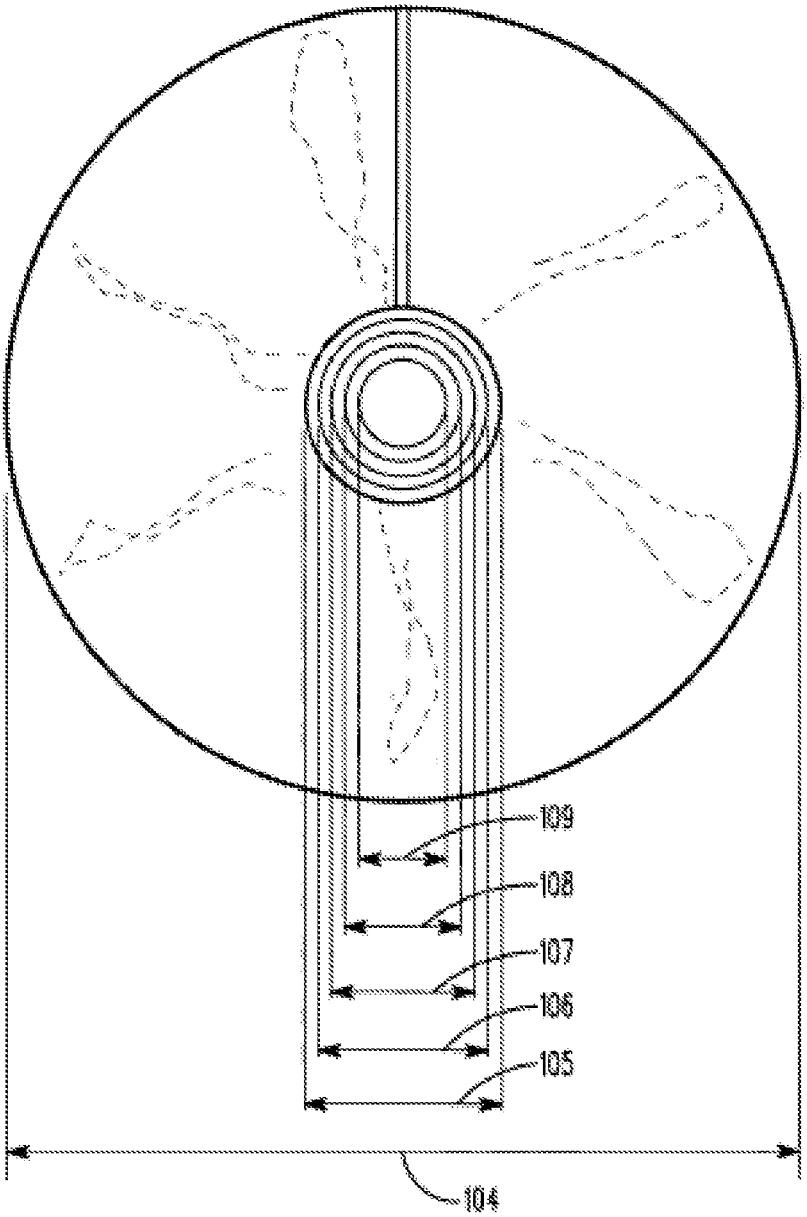
FIG. 11 is an end view of an embodiment of a pad element of the core exercising device of the present invention showing a typical diameter of the pad element as compared to five diameters of five weighted bar elements of the core muscle exercising device.

The pad element 14 in the illustrated embodiment is cylindrical in form, and constructed from a foam material that is relatively lightweight, or negligible in weight, as compared to the weight of the bar element 11 or weights 13A. The pad element 14 of the illustrated embodiment has opposed pad ends and a pad length 101 (FIG. 4) of approximately 12 inches, or a third of the bar length 100. The pad element 14 further comprises a cervical curve-accommodating or receiving outer pad diameter 104 (FIG. 11) in the range of 2.8 to 4.8 inches, thereby effecting a radius of curvature in the range of 1.4 to 2.4 inches. The inner pad diameter is variable to accommodate the insertion of bars 11 of varying diameters, as shown in FIGS. 2, 4 and 11, as generally and variably referenced at 105-109. As seen in FIG. 2, pad element 14 includes a bar-receiving slot 16 and a bar-receiving inner pad tunnel 17.

The pad element 14 in the illustrated embodiment is composed of a foam material having a density in the range of 1.75 to 2.50 pounds per cubic foot. In the embodiment shown in FIG. 1, the density of pad 14 is in the range of 2.15 to 2.25 pounds per cubic foot. Pad elements 14 within this range have been observed to apply the appropriate pressure to the neck muscles, and to receive the neck into the pad element as the pad element deforms to a controlled, firm degree. An example of suitable pad element 14 material is commercially available as high-density foam from Hickory Springs Manufacturing of Hickory, N.C.

Figure 6:
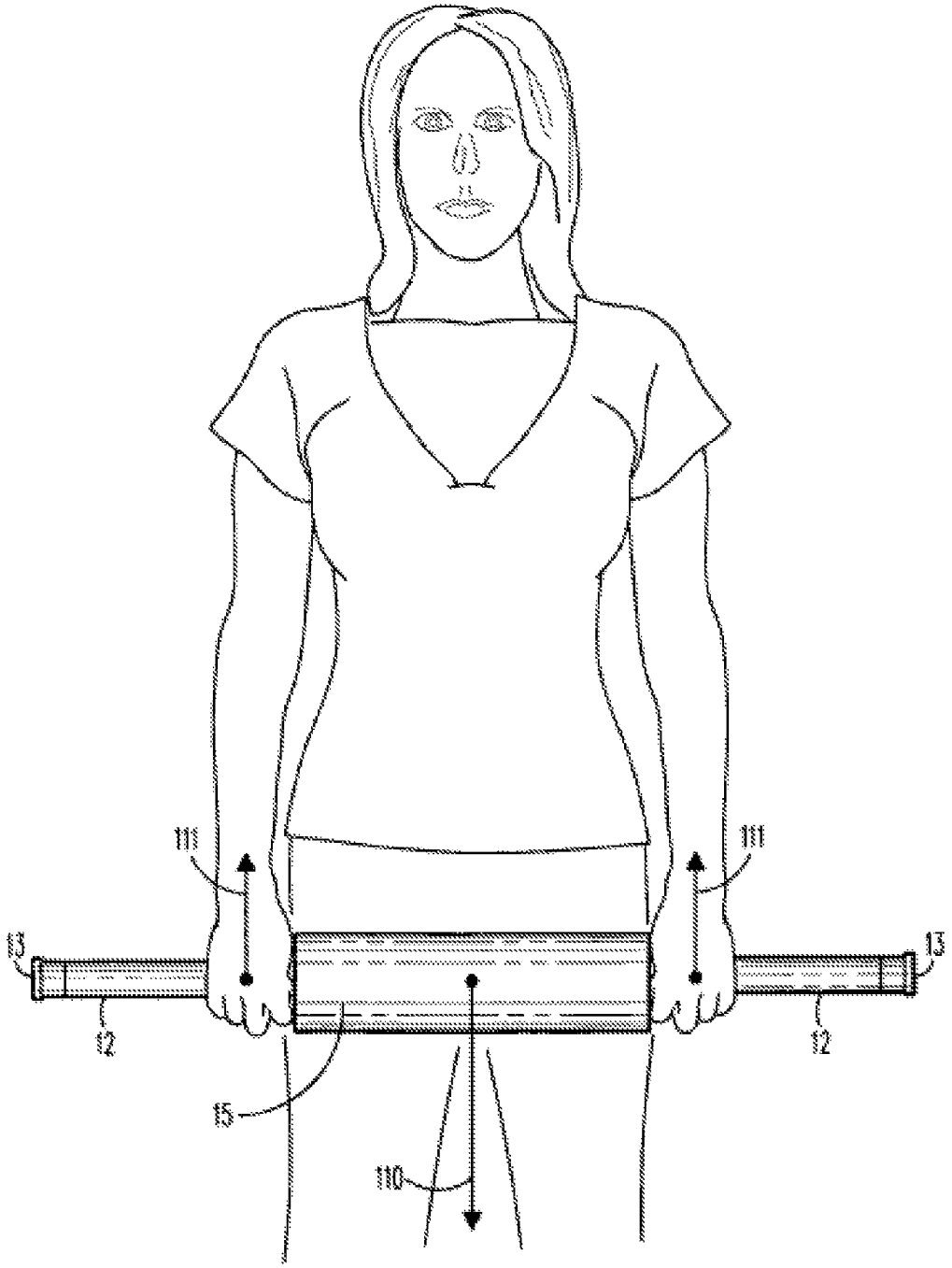
FIG. 6 is a front view of a user holding an embodiment of a weighted core exercising device according to the present invention in a neutral position.
Figure 7:
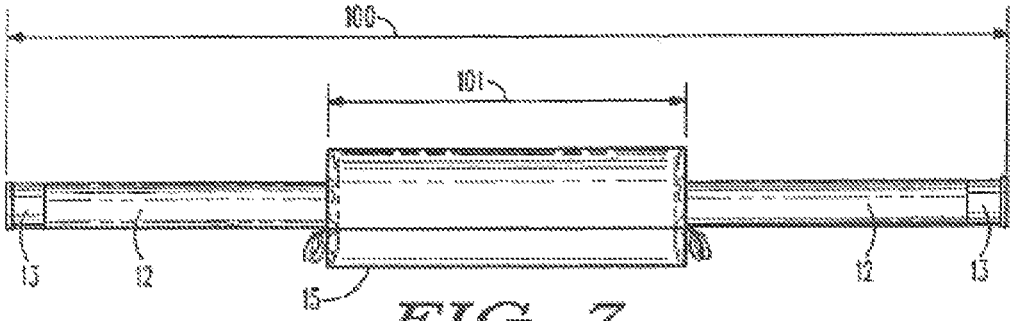
FIG. 7 is a plan view of an embodiment of the core exercising device of the present invention showing the relative lengths of a bar element compared to a pad element of the core muscle exercising device with caps removably attached to the opposed threaded ends of the bar element.

The inner pad tunnel 17 receives the bar element 11 and sheathing 12 such that the bar element 11 and the pad element 14 are coaxial, and the pad element 14 is centered along the bar length 100 equidistant from the bar ends 11A, as generally depicted in FIGS. 4, 6, and 7. The outer pad diameter defines a radius of curvature substantially equal to the radius of curvature for a standard or normalized cervical curve, the latter being shown in FIG. 10. The core muscle exercising device of the present invention, when used, applies pressure to and trains the user's core muscle groups around the neck, shoulders, upper back, and abdominal region, which relate to and affect, cervical curvature. Together, the outer pad diameter, the weighty bar material and the isometric resistance applied by the user function to improve, and/or maintain the user's cervical curve posture. It may be seen from a further inspection of FIGS. 3(*a*) and 3(*b*) that the outer pad diameter 104 (FIG. 11) is specifically sized so as to accommodate or be firmly received in a user's cervical curve for providing tactile information to the user as to how or to what degree the user's cervical curve should be adjusted so as to approximate the radius of curvature of the outer pad diameter 104, which is substantially equal to a normal cervical curvature (FIG. 10).

As seen in FIG. 2, the pad element 14 further comprises a pad sheathing 15, the pad sheathing 15 comprising hook type fastening material 18 co-operable with loop type fastening material 19. Together, the hook and loop fastening material 18 and 19 (e.g. VELCRO® hook and loop fastening material) may function to removably fasten the pad sheathing 15 about the pad element 14. Alternatively, the pad sheathing 15 may comprise ties 20 for removably binding the pad sheathing 15 about the pad element 14. This provides the ability to remove and clean the pad sheathing 15 for hygiene purposes.

In FIG. 11, the dimension or diameter of the bar 11, and also the dimension of pad tunnel 17, is approximated as follows: 105 may represent a diameter on the order of 1.5 inches, the dimension or diameter 106 may represent a diameter on the order of 1.4 inches, the dimension or diameter 107 may represent a diameter on the order of 1.3 inches, the dimension or diameter 108 may represent a diameter on the order of 1.2 inches, and the dimension or diameter at 109 may represent a diameter on the order of approximately 1.1 inches. This structural feature prevents inadvertent axial displacement of the pad element 14 relative to the bar element 11, there being sufficient friction between the bar element 11 and sheathing 12 and the pad element 14 to prevent axial movement of the bar 11 relative to the pad 14.

The approximately three foot bar length 100 (FIG. 4) allows the device 10 to be properly positioned behind the user's neck adjacent the cervical neck curvature, with the user firmly gripping both ends of the bar with the elbows at substantially ninety degrees, and applying pressure to the neck, thus producing positive resistance by the cervical muscles against the cylindrical pad element 14. A larger bar element 11 would also be acceptable, subject to certain exercise limitations. However, a shorter bar element would not allow the user to correctly grip the device 10 in the proper posture, as shown in FIG. 4. The bar element 100 may come in multiple sections so that it can be broken down for travel. The bar diameter is not important regarding the grip of the device 10, but the bar diameter is important regarding the weight of the bar. Different bar diameters equate to different bar weights, which are required for strength training and/or posture improvement via weight-bearing exercise. The material density when combined with the bar length and diameter provide a specific weight, or a specific variety of weights in the claimed invention. Also, the downward force provided by additional weights 13A, when attached to bar 11 (FIG. 2), is used for enhanced strength training.

Given the approximately 36" length for each bar element 11, and the additional weights 13A, it is contemplated that a variety of weights may be made available in use of the bar 10, depending on the user's physique, fitness level and capabilities. Because the material of the bar 11 can vary, and additional weights 13A have a uniform or constant average density, the methods for altering or differing the downwardly directed weight (FIG. 4) across the varied bar elements 11 may be practiced by changing the diameter or cross-sectional area of each bar element 11, and/or by attaching weights 13A of different values to the ends of bar 11. In an embodiment of the present invention, the individual weights 31A vary from one to twenty pounds.

Various specific sizes are possible, but it is preferred that steel bar element 11 has a diameter on the order of approximately 1.5 inches and weigh of approximately 240 ounces (15 pounds), a diameter on the order of 1.4 inches and weigh approximately 192 ounces (12 pounds), a diameter on the order of 1.3 inches and weigh approximately 144 ounces (9 pounds), a diameter on the order of 1.2 inches and weigh approximately 96 ounces (6 pounds), or a diameter on the order of 1.1 inches and weigh approximately 48 ounces (4 pounds).

Figure 7A:
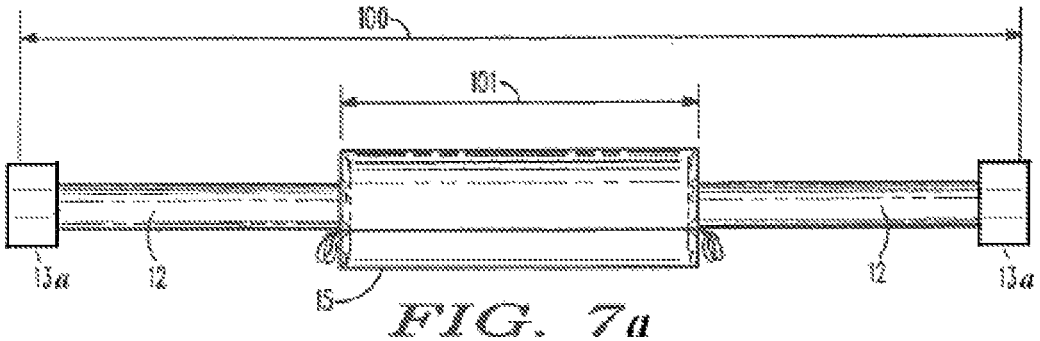

The foregoing figures are based on a cylindrical geometry for each steel bar element 11 with a length of 36 inches. The formula for the volume of a cylinder is as follows:

$$\Pi r^2 h,$$

where "π" is a constant, "r" is the radius of the cylinder, and "h" is the height or length of the cylinder. By way of example, with each bar 11 having a relatively constant material density of 4.54 ounces/inch$^3$ or 490 pounds/foot$^3$, it is contemplated that devices 10 ranging from 10 to 18 pounds in 2 pound increments may well be described by the foregoing descriptions, without the additional weights 13A. The use of additional weights 13A, as shown in FIG. 7*a*, allows the total weight of the device 10 to be increased or decreased in smaller increments.

It is also possible to use a lighter weight bar element 11, for example that constructed from wood, rigid PVC or tubular steel. In such an embodiment, bar element 11 may comprise a diameter on the order of 1.25 inches and weigh approximately 18 (1.1 pounds).

Together, the muscular activity associated with resistance training as operating against the back of the neck, which resistance training is generically represented by vectors 111 in FIG. 4, and the outer pad diameter 104 in the range of 2.8 to 4.8 inches, resulting in a radius of curvature in the range of 1.4 to 2.4 inches that substantially matches that of a normal cervical curve 102 (FIG. 10), operate to strengthen the core muscles associated with improving and/or maintaining posture, particularly cervical neck curve posture.

As earlier specified, an illustrated embodiment of the core exercising device 10 according to the present invention may preferably comprise both bar sheathing 12 and a pad sheathing 15 to provide an interface between the user's body and the underlying material constructions. In this regard, the bar sheathing 12 may be constructed from a cushion-like material and may thus cushion-coat the bar element 11. End caps 13 or when attached, additional weights 13A, prevent the bar sheathing 12 from becoming disengaged from the bar element 11.

The pad sheathing 15 provides a function of sealing the bar-receiving slot 16 for preventing disassembly of the pad element 14 from the bar element 11. Notably, since the pad sheathing 15 comes into regular contact with the user's rear neck area, the pad sheathing 15 in the illustrated embodiment is preferably removable from the pad element 14 and constructed from a washable material for properly maintaining the core exercising device 10.

In an additional embodiment, the bar element 11 is lighter than 4 pounds. This embodiment is primarily intended for use by those who are interested in developing and maintaining the posture and flexibility of the neck, shoulders, back and abdominal muscles, such as senior citizens and those seeking golf swing training, or individuals with pulmonary issues. In this embodiment, bar element 11 weighs in the range of one to three pounds, and the pad element 14 as described previously is removably attached to the lighter bar element 11. This embodiment may be beneficial for a user whose cervical curvature is normal.

In a further embodiment, the weights of bar elements 11 can be 6; 9; 12 and 15 pounds, with no threads on the ends of the bar element.

The foregoing specifications of the device 10 support certain methodology for improving posture, which posture improving method essentially comprises the steps of providing a weighted bar 11 with or without additional weights 13A attached, which bar has a bar length and a downwardly directed weight (FIGS. 3A, 3B, 10), as well as isometric resistance against the back of the neck. The bar is then outfitted with a pad 14, which pad comprises an outer pad diameter or radius of curvature substantially equal in magnitude to the radius of curvature of a normal cervical curve, in the range of 1.4 to 2.4 inches.

Figure 5:
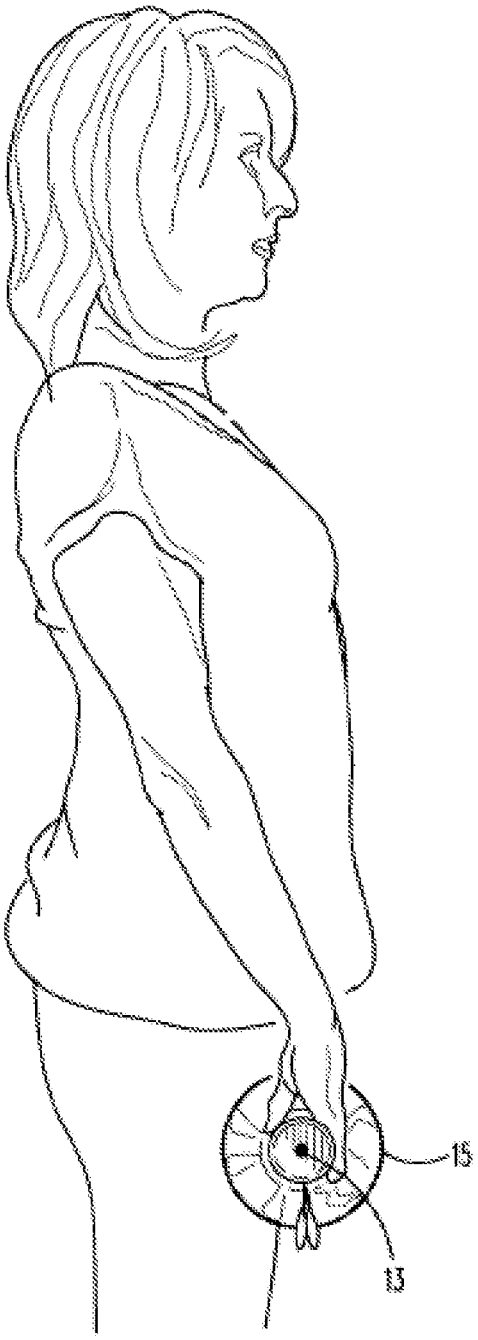
FIG. 5 is a side view of a user holding an embodiment of a weighted core exercising device of the present invention in a neutral position.

In use, the pad 14 is axially centered relative to the bar 11 length and includes opposed pad ends. The method comprises the additional step of manually holding the bar with the user's hands adjacent the pad ends as generally depicted in FIGS. 6 and 8. It may be further seen from an inspection of FIGS. 5 and 6 that the pad functions to space the user's hands at least shoulder width apart. FIGS. 5 and 6 depict the neutral position. It will be understood from a consideration of the figures that in the neutral position, the outfitted, weighted bar is anteriorly received adjacent the user's thighs and there maintained via upwardly directed forces 111.

FIGS. 3(*a*), 3(*b*), 4, and 8 depict the device 10 posteriorly received adjacent the user's cervical neck curve with the user applying isometric resistance against device 10 for a predetermined period of time. This position of the device 10 is maintained for further resistance training of the user's core cervical curve muscles, which resist the downwardly directed weight of the bar 11 and additional weights 13A, thereby functioning to improve posture via resistance training of the core cervical curve muscles. The weighted caps 13A (FIG. 2) and the resistance bands 71 (FIG. 8) when used, increase the downwardly directed weight applied to the core cervical muscles, thereby providing more strenuous resistance training of the core cervical muscles. The bar 11 may be selected from among several bar diameters, and the method also may comprise the additional step of selecting the appropriate bar volume from the group consisting of 18 inches$^3$, 28 inches$^3$, 44 inches$^3$, 55 inches$^3$, and 64 inches$^3$.

Also, the method of the present invention includes the step of selecting an appropriate additional weight 13A for attachment to bar 11 to provide the optimum weight of device 10. Additionally, referring to FIG. 8, a method of the present invention further includes attaching one end of a pair of elastic resistance bands 71 to the ends of bar 11, and securing the other ends of the resistance bands 71 to a spaced location, such as the ankle, shoe or foot of the user, or the floor on which the user is standing or other static fixture. The combination of the manual isometric resistance applied to bar 11 and pad 14, augmented by the downward pressure on bar 11 and pad 14 applied by resistance bands 71, apply the appropriate downward force to the device 10 to provide resistance training of the cervical curve core muscles of the user, resulting in an improvement to an abnormal cervical curvature.

The foregoing description of an illustrated embodiment of the invention has been presented for purposes of illustration and description, and is not intended to be exhaustive or to limit the invention to the precise form disclosed. The description was selected to best explain the principles of the invention and practical application of these principles to enable others skilled in the art to best utilize the invention in various embodiments and various modifications as are suited to the particular use contemplated. It is intended that the scope of the invention not be limited by the specification, but be defined by the claims set forth below.

What is claimed is:

1. A method for improving abnormal cervical curvature in a user including the steps of:

A. Selecting a candidate for improvement, said candidate having a cervical curvature less than approximately 34 degrees, or greater than about 42 degrees, measured as an angle between the C2-C7 vertebrae from a side view of the candidate's spine;

B. Providing a weighted, rigid bar to said candidate, said bar including a substantially cylindrical pad element frictionally longitudinally mounted approximately equidistant from ends of said bar and gripping portions distal to said pad element, said pad element and bar combination having a mounted diameter of between approximately 2.8 to approximately 4.8 inches, said pad element having a pad sheathing surrounding an outer surface of said pad element and removable from said pad element by a fastener;

C. Applying said pad to portion of said candidate's body adjacent cervical curvature;

D. Generating isometric resistance to said portion of said candidate's body adjacent cervical curvature, by said candidate holding said gripping portions with their hands and exerting forwardly directed force on said weighted bar; and E. Incrementally repeating said candidate's application of isometric resistance until said candidate exhibits a cervical curvature of in the range of approximately 34 degrees to approximately 42 degrees.

2. The method of claim 1 wherein said step of providing a weighted bar to said candidate includes the step of including a weighted bar having threads at opposing ends.

3. The method of claim 2 wherein said step of providing a weighted bar having threads at opposing ends further includes the step of providing downward force elements selected from weights, resistance bands, and combinations thereof.

4. The method of claim 3 wherein said step of providing downward force elements further includes the step of engaging said downward force elements with said opposing ends.

5. A method for maintaining normal cervical curvature in a user including the steps of:

A. Selecting a candidate predisposed for losing normal cervical curvature, said candidate having a cervical curvature between approximately 34 and 42 degrees, measured as an angle between the C2-C7 vertebrae from a side view of the candidate's spine;

B. Providing a weighted, rigid bar to said candidate, said bar including a substantially cylindrical pad element frictionally longitudinally mounted approximately equidistant from ends of said bar and gripping portions distal to said pad element, said pad element and bar combination having a mounted diameter of between approximately 2.8 to approximately 4.8 inches, said pad element having a pad sheathing surrounding an outer surface of said pad element and removable from said pad element by a fastener;

C. Applying said pad to portion of said candidate's body adjacent cervical curvature; and D. Generating isometric resistance to said portion of said candidate's body adjacent cervical curvature, by said candidate holding said gripping portions with their hands and exerting forwardly directed force on said weighted bar.

* * * * *